US009891560B2

(12) United States Patent
Ohmura

(10) Patent No.: US 9,891,560 B2
(45) Date of Patent: Feb. 13, 2018

(54) IMAGE FORMING SYSTEM

(71) Applicant: Tomoya Ohmura, Kanagawa (JP)

(72) Inventor: Tomoya Ohmura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/265,038

(22) Filed: Sep. 14, 2016

(65) Prior Publication Data

US 2017/0003629 A1 Jan. 5, 2017

Related U.S. Application Data

(63) Continuation of application No. 14/718,567, filed on May 21, 2015, now Pat. No. 9,459,565.

(30) Foreign Application Priority Data

May 30, 2014 (JP) ..... 2014-112896
Jul. 25, 2014 (JP) ..... 2014-151327

(51) Int. Cl.
*G03G 15/16* (2006.01)
*G03G 21/14* (2006.01)

(52) U.S. Cl.
CPC ..... *G03G 15/1665* (2013.01); *G03G 15/168* (2013.01); *G03G 15/1675* (2013.01); *G03G 21/14* (2013.01); *G03G 2215/00599* (2013.01)

(58) Field of Classification Search
None
See application file for complete search history.

(56) References Cited

U.S. PATENT DOCUMENTS 5,701,551 A 12/1997 Honda
5,715,499 A 2/1998 Yamazaki et al.
5,729,788 A 3/1998 Hirohashi et al.
5,884,121 A 3/1999 Kyung
6,535,712 B2 * 3/2003 Richards ..... G03G 13/08 399/341
2005/0281570 A1 12/2005 Takeuchi
2007/0264053 A1 11/2007 Iwata et al.
2008/0298844 A1 12/2008 Katoh et al.
(Continued)

FOREIGN PATENT DOCUMENTS

JP 2003-140477 5/2003
JP 2012-042641 3/2012
JP 2012-063497 3/2012

*Primary Examiner* — Sevan A Aydin
(74) *Attorney, Agent, or Firm* — Oblon, McClelland, Maier & Neustadt, L.L.P.

(57) ABSTRACT

An image forming apparatus includes an image bearer; a transfer rotator to contact the image bearer to form a transfer nip therebetween; a bias application device to apply, to the transfer rotator, a transfer bias, a cleaning bias to remove toner adhering to the transfer rotator, and a non-image area bias smaller in absolute value than the cleaning bias; and a controller to control the bias application device and set a sheet feeding interval according to a predetermined condition. When the sheet feeding interval exceeds a predetermined threshold, the controller causes the bias application device to apply, to the transfer rotator, the non-image area bias for an application time Z and the cleaning bias for a time X−Z within the sheet feeding interval when X represents the sheet feeding interval, and the application time Z is increased as the sheet feeding interval is increased.

17 Claims, 10 Drawing Sheets

(56) References Cited

U.S. PATENT DOCUMENTS

| | | | | |
|---|---|---|---|---|
| 2008/0298845 | A1 | 12/2008 | Ohmura et al. | |
| 2008/0298866 | A1 | 12/2008 | Matsumoto et al. | |
| 2009/0028611 | A1 | 1/2009 | Matsumoto et al. | |
| 2009/0123174 | A1 | 5/2009 | Iwata et al. | |
| 2009/0317106 | A1 | 12/2009 | Ohmura et al. | |
| 2010/0061774 | A1 | 3/2010 | Iwata et al. | |
| 2010/0124443 | A1 | 5/2010 | Ohmura et al. | |
| 2010/0143000 | A1 | 6/2010 | Matsue et al. | |
| 2011/0182610 | A1 | 7/2011 | Ohmura et al. | |
| 2011/0229207 | A1 | 9/2011 | Matsumoto et al. | |
| 2011/0268478 | A1 | 11/2011 | Ohmura et al. | |
| 2012/0039623 | A1 | 2/2012 | Hiramatsu | |
| 2012/0051791 | A1 | 3/2012 | Ohmura et al. | |
| 2012/0051792 | A1 | 3/2012 | Matsumoto et al. | |
| 2012/0057890 | A1 | 3/2012 | Takuma et al. | |
| 2012/0076522 | A1 | 3/2012 | Amaike | |
| 2012/0114349 | A1 | 5/2012 | Matsumoto et al. | |
| 2012/0230733 | A1 | 9/2012 | Kikuchi et al. | |
| 2012/0237259 | A1* | 9/2012 | Tanda ..... | G03G 15/2035 399/122 |
| 2012/0275806 | A1* | 11/2012 | Takezawa ..... | G03G 15/0131 399/51 |
| 2014/0056604 | A1 | 2/2014 | Hayakawa | |
| 2014/0112687 | A1 | 4/2014 | Ohmura et al. | |
| 2015/0110510 | A1 | 4/2015 | Ishikawa | |

* cited by examiner

FIG. 8

| LINEAR SPEED | CORRECTION COEFFICIENT OF CLEANING BIAS 1 (−) | CORRECTION COEFFICIENT OF CLEANING BIAS 2 (+) |
|---|---|---|
| 75mm/s | 67 | 59 |
| 150mm/s | 83 | 77 |
| 260mm/s | 100 | 100 |

FIG. 9

| ABSOLUTE TEMPERATURE | CLEANING BIAS 1 (−) | CLEANING BIAS 2 (+) |
|---|---|---|
| $D \leq 4.0$ | −4 μA | 10 μA |
| $4.0 < D \leq 8.0$ | −5 μA | 12 μA |
| $8.0 < D \leq 16.0$ | −6 μA | 14 μA |
| $16.0 < D$ | −8 μA | 16 μA |

IMAGE FORMING SYSTEM

CROSS-REFERENCE TO RELATED APPLICATIONS

This patent application is a continuation of U.S. patent application Ser. No. 14/718,567 filed May 21, 2015, which is based on and claims priority pursuant to 35 U.S.C. § 119(a) to Japanese Patent Application Nos. 2014-112896 filed on May 30, 2014 and 2014-151327 filed on Jul. 25, 2014, in the Japan Patent Office, the entire disclosure of each of which is hereby incorporated by reference herein.

BACKGROUND

Technical Field

Embodiments of the present invention generally relates to an electrophotographic image forming apparatus such as a copier, a facsimile machine, a printer, or a multifunction peripheral (MFP, i.e., a multifunction machine) having at least two of copying, printing, facsimile transmission, plotting, and scanning capabilities.

Description of the Related Art

Image forming apparatuses such as copiers and printers generally include a transfer roller to press against an image bearer, and a contact therebetween is called "transfer nip" (i.e., a transfer position). It is possible that toner transferred from the image bearer adheres to the transfer roller. Then, when a recording medium such as a paper sheet is nipped in the transfer nip, it is possible that a back side or an edge face of the recording medium is soiled with toner transferred from the transfer roller. To prevent such soil of toner of the sheet, for example, a cleaning bias different from a transfer bias is applied to the transfer roller in intervals between sheets transported to the transfer nip between the transfer roller and the image bearer.

SUMMARY

An embodiment of the present invention provides an image forming apparatus that includes an image bearer to rotate and bear a toner image, a transfer rotator to rotate and contact the image bearer to form a transfer nip therebetween, a bias application device to apply multiple biases to the transfer rotator, and a controller to control the bias application device and set a sheet feeding interval (an interval between sheets) in successive sheet feeding according to a predetermined condition. The multiple biases includes a transfer bias to transfer the toner image from the image bearer onto the sheet transported to the transfer nip, a cleaning bias to remove toner adhering to the transfer rotator, and a non-image area bias smaller in absolute value than the cleaning bias.

When the sheet feeding interval exceeds a predetermined threshold, the bias application device executes application of the non-image area bias for an application time Z within the sheet feeding interval, and the time Z is set to an increased length of time as the sheet feeding interval is increased. When X represents the sheet feeding interval, application of the cleaning bias is executed for a time period expressed as X−Z within the sheet feeding interval.

In another embodiment, an image forming apparatus includes the above-described image bearer, the transfer rotator, a backup roller disposed to contact the transfer rotator via the image bearer, and a bias application device to apply the multiple biases to at least one of the transfer rotator and the backup roller. The controller controls bias application device as described above.

In yet another embodiment, an image forming apparatus includes the above-described image bearer, the transfer rotator, and a bias application device to apply, to the transfer rotator, the transfer bias and the cleaning bias described above. The image forming apparatus further includes a controller to cause the bias application device to keep a current value applied to the transfer rotator at zero for an application time Z within an interval between sheets in successive feeding of sheets. The application time Z is set to an increased length of time as the interval between sheets is increased. When X represents the interval between sheets, the bias application device is to execute application of the cleaning bias for an application time expressed as X−Z within the interval between sheets.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 8 is a table of correction coefficients of cleaning biases for each process speed when the process speed is variable in multiple stages, according to an embodiment;

FIG. 9 is a table of example settings of cleaning biases variable in accordance with absolute humidity, according to an embodiment;

DETAILED DESCRIPTION

Figure 1:
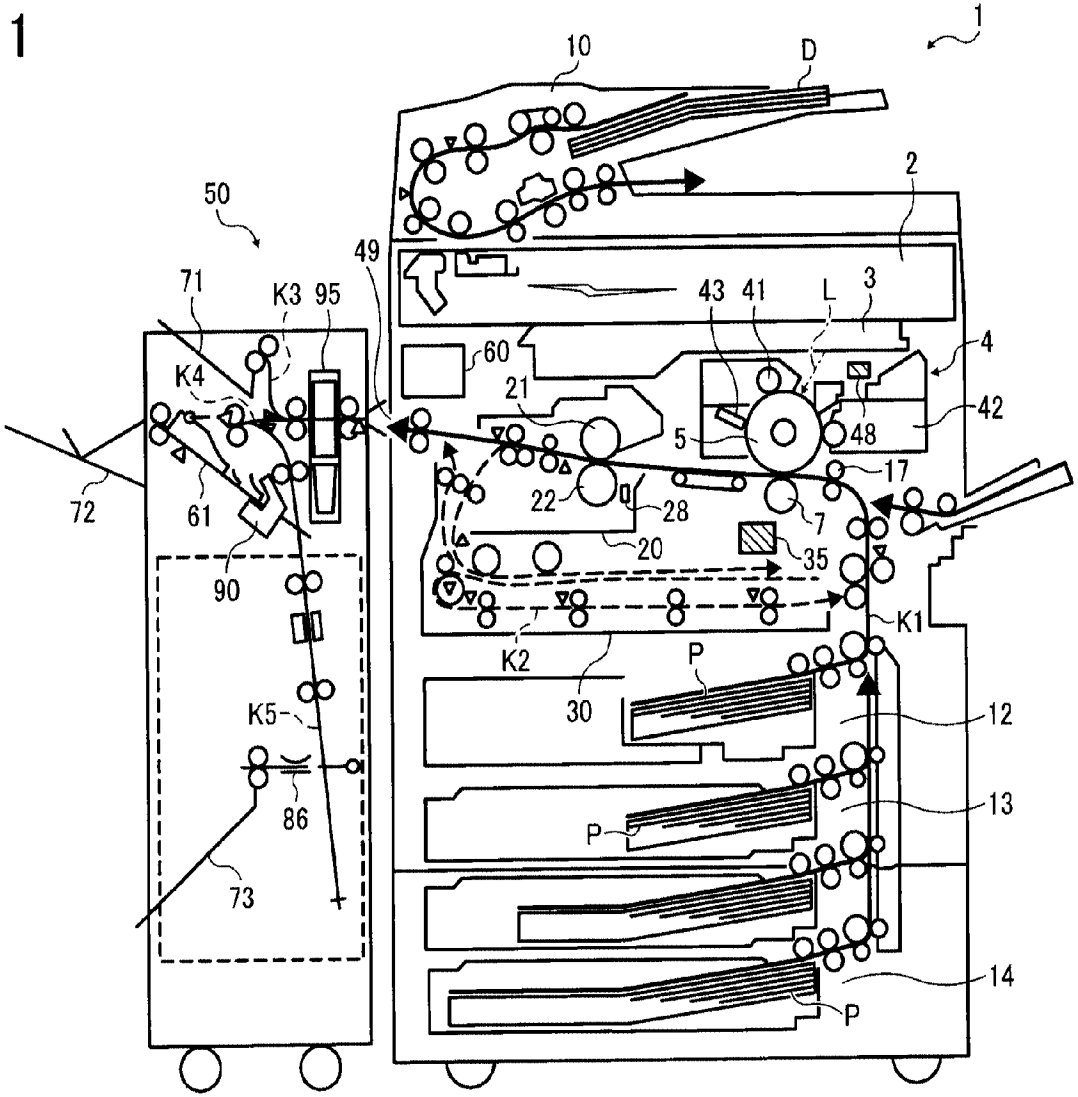
FIG. 1 is a schematic diagram illustrating a configuration of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of the present invention is described.

Firstly, the entire configuration and functions of an image forming apparatus 1 are described with reference to FIG. 1.

The image forming apparatus 1 illustrated in FIG. 1 is, for example, a copier and includes a document reader 2, an exposure device 3, an image forming unit 4 to form a toner image on a surface of a photoconductor drum 5, a transfer roller 7, a document feeder 10 to feed a document D set thereon to the document reader 2, sheet trays 12 through 14 to accommodate a stack of sheets P (recording media), a registration roller pair 17 (timing rollers), a fixing device 20 to fix the toner image on the sheet P, and a sheet reversal unit 30 to reverse the sheet P upside down and transport the sheet P again to the image forming unit 4 after the toner image is formed on a first side (front side) thereof. The document reader 2 optically reads image data of the document D, according to which the exposure device 3 emits a laser beam L to the surface of the photoconductor drum 5. The transfer roller 7 transfers the toner image onto the sheet P. The registration roller pair 17 feeds the sheet P to a position where the transfer roller 7 contacts the photoconductor drum 5. The fixing device 20 includes a fixing belt 21 and a pressure roller 22.

Additionally, reference numeral 50 represents a sheet processing apparatus (post-processing apparatus) to process the sheets P discharged from the image forming apparatus 1. The sheet processing apparatus 50 includes an internal tray 61 disposed inside the sheet processing apparatus 50, first, second, and third output trays 71, 72, and 73 to store the sheets P or bundles of sheets P discharged from the sheet processing apparatus 50, a center-folding plate 86 to fold the sheets P, a stapler 90, and a punch 95. The sheet processing apparatus 50 is removably connected to the image forming apparatus 1.

Referring to FIG. 1, the image forming unit 4 includes the photoconductor drum 5 serving as an image bearer, a charging roller 41 (i.e., a charging device), a developing device 42, the transfer roller 7, a cleaning device 43, and the like.

The photoconductor drum 5 used in the present embodiment is an organic photoconductor charged to a negative polarity and includes a photosensitive layer overlying a drum-shaped conductive base. For example, the photoconductor drum 5 is multilayered, and a base coat serving as an insulation layer, and a photosensitive layer are provided sequentially on the conductive base. The photosensitive layer includes a charge generation layer and a charge transport layer. The photoconductor drum 5 is rotated clockwise in FIG. 1 by a driving motor. A temperature and humidity sensor 48 is disposed adjacent to the photoconductor drum 5 to detect a temperature of the photoconductor drum 5.

In one embodiment, the charging roller 41 includes a conductive cored bar and an elastic layer of moderate resistivity overlying an outer circumference of the cored bar. The charging roller 41 is disposed to contact the photoconductor drum 5. Receiving a predetermined voltage from a power source, the charging roller 41 uniformly charges the surface of the photoconductor drum 5 facing the charging roller 41.

The developing device 42 includes a developing roller disposed facing the photoconductor drum 5, two conveying screws disposed side by side via a partition, and a doctor blade opposed to the developing roller. The developing roller includes stationary magnets or a magnet roller and a sleeve that rotates around the magnets. The magnets generate magnetic poles around the circumferential surface of the developing roller. Developer is borne on the development roller by the multiple magnetic poles. The developing device 42 contains two-component developer including carrier (carrier particles) and toner (toner particles). Additionally, a replaceable toner container to contain fresh toner is removably attached to the developing device 42.

With the developing device 42 having such a structure, toner is transferred from the developing roller to an electrostatic latent image on the photoconductor drum 5 by the electrical field generated in the developing range where the developing roller faces the photoconductor drum 5. Thus, a desired toner image is formed on the photoconductor drum 5.

It is to be noted that toner dedicated for high speed machines, having a lower melting point, is used in the present embodiment.

Specifically, the toner usable in the present embodiment includes a binder resin that includes, at least, crystalline polyester resin (A), noncrystalline resin (B), noncrystalline resin (C), and composite resin (D) that includes a polycondensation resin unit and an addition polymerization resin unit. The noncrystalline resin (B) contains an insoluble chloroform component, and the noncrystalline resin (C) is lower in softening temperature (T½) than the noncrystalline resin (B) by 25° C. or greater. In a molecular-weight distribution according to gel permeation chromatography (GPC) obtained by a soluble tetrahydrofuran (THF) component of toner, a main peak is within 1000 to 10000, and a full width at half maximum of the molecular-weight distribution is at or lower than 15000.

Although such a toner has a lower melting point and suitable for high-speed image formation, the possibility of adhesion of paper dust and decreases in amount of charge are high, and the toner is likely to adhere to the transfer roller 7. Accordingly, cleaning of the transfer roller 7 to remove the toner is effective.

The cleaning device 43 includes a cleaning blade to contact the surface of the photoconductor drum 5 and remove toner and the like adhering to the photoconductor drum 5. In one embodiment, the cleaning blade includes a planar blade body made of rubber, such as urethane rubber, hydrin rubber, silicone rubber, and fluororubber, and a blade support to hold the rubber blade body. The cleaning blade contacts the surface of the photoconductor drum 5 at a predetermined angle and pressure. With this configuration, substance such as toner and dust adhering to the surface of the photoconductor drum 5 is mechanically scraped off and collected in the cleaning device 43.

It is to be noted that the image forming apparatus 1 according to the present embodiment may further includes a recycle toner tube to feed the toner collected by the cleaning device 43 to the developing device 42.

The transfer roller 7 serving as a rotatable transfer device includes a conductive cored bar and an elastic layer overlying an outer circumference of the cored bar, and the elastic layer has a resistance value of about $10^6\Omega$ to $10^9\Omega$ under conditions of a temperature of 23° C., a humidity of 50% RH (relative humidity), and application of direct-current (DC) voltage of 1000 V. The transfer roller 7 is pressed against the photoconductor drum 5, and the contact portion therebetween is hereinafter referred to as "transfer nip". The transfer roller 7 is rotated in a predetermined direction (counterclockwise in FIG. 1) by a driving motor. In another embodiment, the transfer roller 7 is rotated by not the driving motor but friction force with the photoconductor drum 5.

The image forming apparatus 1 further includes a power supply 35 serving as a bias application device to apply a transfer bias to the transfer roller 7, thereby transferring the toner image from the photoconductor drum 5 to the sheet P fed to the transfer nip therebetween. Specifically, the transfer bias applied by the power supply 35 to the transfer roller 7 is different in polarity (positive in the present embodiment) from the polarity of toner to transfer the toner image from the photoconductor drum 5 onto the sheet P nipped in between the photoconductor drum 5 and the transfer roller 7.

It is to be noted that, in the present embodiment, the power supply 35 applies the transfer bias using constant current control. In transfer devices employing the constant current control, the bias applied to the transfer roller 7 is adjusted to keep the value of current constant during sheet feeding. Then, the toner image on the photoconductor drum 5 is attracted to the first side of the sheet P by applying electrical charges opposite in polarity to toner to the back side (the side on which the toner image is not to be transferred) of the sheet P.

In transfer devices of direct-transfer type, in which toner is directly transferred from the photoconductor drum 5 onto the sheet P nipped therebetween (the transfer nip), the transfer roller 7 directly contacts the photoconductor drum 5 when the sheet P is not nipped therebetween. Accordingly, if the transfer bias is applied to the transfer roller 7 in that state, toner adhering to non-image areas of the photoconductor drum 5 is transferred onto the transfer roller 7. That is, the transfer roller 7 is soiled with toner. It is to be noted that, when the charge of toner is insufficient or mechanical pressure is applied thereto, toner can adhere to the non-image areas of the photoconductor drum 5, and this phenomenon is referred to as "background fog" or "background stains". If the transfer roller 7 is soiled with toner, the toner is transported to the transfer nip and further transferred to the back side or the edge face of the sheet P.

Therefore, in the present embodiment, a cleaning bias is applied to the transfer roller 7 in a predetermined period described later (such as interval between sheets) to prevent the transfer current from flowing to the transfer roller 7, thereby suppressing adhesion of toner to the transfer roller 7. Alternatively, the cleaning bias is applied to transfer the toner from the transfer roller 7 to the photoconductor drum 5, thereby cleaning the transfer roller 7.

Standard image forming operation of the image forming apparatus 1 illustrated in FIG. 1 is described below.

In the document feeder 10, conveyance rollers transport the document D from a document table in a direction indicated by an arrow in FIG. 1 above the document reader 2. Then, the document reader 2 optically reads image data of the document D passing above the document reader 2.

The image data read by the document reader 2 is converted to electric signals and transmitted to the exposure device 3. Then, the exposure device 3 emits the laser beam L according to the electric signals indicating the image data to the surface of the photoconductor drum 5 of the image forming unit 4.

In the image forming unit 4, the photoconductor drum 5 rotates clockwise in FIG. 1, and an image according to the image data is formed on the photoconductor drum 5 through predetermined image forming processes such as charging, exposure, and developing processes.

Subsequently, in the transfer nip between the transfer roller 7 and the photoconductor drum 5, the image is transferred from the surface of the photoconductor drum 5 onto the sheet P transported by the registration roller pair 17.

The sheet P moves to the transfer roller 7 as follows.

Initially, one out of the sheet trays 12, 13, and 14 of the image forming apparatus 1 is selected automatically or manually. For example, the sheet tray 12 on the top is selected.

Then, the sheet P on the top on the sheet tray 12 is fed to a sheet conveyance path K1 defined by multiple conveyance rollers arranged between the sheet tray 12 and a discharge roller pair.

The sheet P is transported through the sheet conveyance path K1 to the registration roller pair 17, which forwards the sheet P to the transfer roller 7, timed to coincide with arrival of the image borne on the surface of the photoconductor drum 5.

Subsequently, the sheet P is transported further to the fixing device 20 through the sheet conveyance path K1. The sheet P is then nipped between the fixing belt 21 and the pressure roller 22, and the image carried thereon is fixed with heat and pressure exerted from the fixing belt 21 and the pressure roller 22, which is a fixing process. After the image is fixed thereon, the sheet P is released from the fixing belt 21 and the pressure roller 22 and discharged through a sheet outlet 49 outside the image forming apparatus 1. The sheet outlet 49 is connectable to the sheet inlet 50*a* of the sheet processing apparatus 50.

Thus, in single-side printing, the sheet P is discharged after the image is fixed on the front side thereof. By contrast, in duplex printing to form images on both sides (front side and back side) of the sheet P, the sheet P is guided to the sheet reversal unit 30 through a sheet reversal path K2 defined by multiple conveyance rollers arranged between the fixing device 20 and the sheet reversal unit 30 and those provided in the sheet reversal unit 30. After the direction in which the sheet P is transported (sheet conveyance direction) is reversed in the sheet reversal unit 30, the sheet P is transported again to the transfer roller 7. Then, through the image forming processes similar to those described above, an image is formed on the back side of the sheet P and fixed thereon by the fixing device 20, after which the sheet P is discharged from the image forming apparatus 1.

In the present embodiment, the image forming apparatus 1 is provided with the sheet processing apparatus 50, and the sheet P discharged from the image forming apparatus 1 enters the sheet processing apparatus 50 for post-processing.

Referring to FIG. 1, in the sheet processing apparatus 50 according to the present embodiment, depending on post-processing type, the sheet P is transported through one of three sheet conveyance paths (first, second, and third conveyance paths K3, K4, and K5) defined by multiple conveyance rollers and guides. The first conveyance path K3 extends from an sheet inlet 50*a* (in FIG. 2) of the sheet processing apparatus 50 to the first output tray 71, to which the sheet P is transported when no post-processing is performed or only punching by the punch 95 is performed. The second conveyance path K4 extends from the sheet inlet 50*a* to the internal tray 61 and further to the second output tray 72 (an external tray). The stapler 90 staples a trailing end of a bundle of sheets P placed on the internal tray 61, after which the bundle of stapled sheets P (hereinafter "sheet bundle PT)" is discharged onto the second output tray 72 by ejection rollers 55 (in FIG. 2) through a sheet outlet 50*b* (in FIG. 2). The third conveyance path K5 is for transporting the sheet P temporarily to the second conveyance path K4 and switchbacking the sheet P to the center-folding plate 86 and a center-folding blade 84 (in FIG. 2). The third conveyance path K5 extends to the third output tray 73.

It is to be noted that the conveyance route of the sheet P can be switched among the first, second, and third conveyance paths K3, K4, and K5 by rotating a bifurcating claw 81. The sheet P transported through the second and third conveyance paths K4 and K5 can be punched by the punch 95 similar to the sheet transported through the first conveyance path K3.

Figure 2:
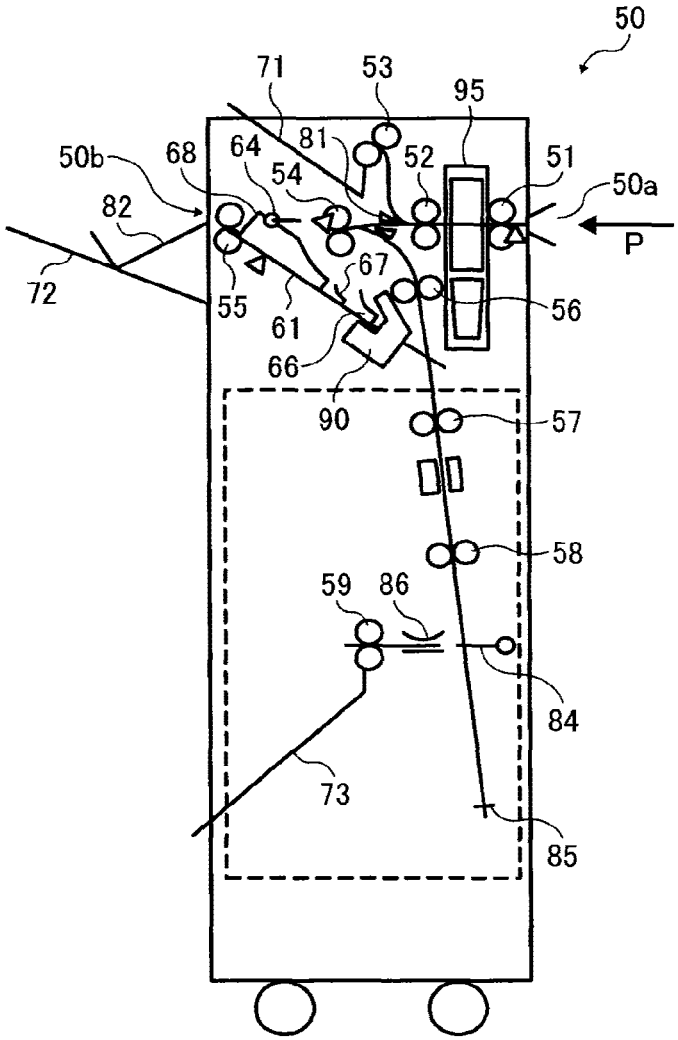
FIG. 2 is a schematic cross-sectional view of a sheet processing apparatus according to an embodiment.

More specifically, referring to FIG. 2, a first conveyance roller pair 51 and a sheet sensor are disposed adjacent to the sheet inlet 50*a* of the sheet processing apparatus 50, and the sheet P detected by the sheet sensor is transported inside the sheet processing apparatus 50 by the first conveyance roller pair 51 and a second conveyance roller pair 52. When punching is preliminarily selected by a user, the punch 95 punches the sheet P.

According to the post-processing selected by the user, the bifurcating claw 81 rotates to guide the sheet P to one of the first, second, and third conveyance paths K3, K4, and K5.

When no post-processing is selected, the sheet P transported to the first conveyance path K3 is discharged by a third conveyance roller pair 53 to the first output tray 71.

A fourth conveyance roller pair 54 is disposed upstream from the ejection rollers 55 in the second conveyance path K4 in the sheet conveyance direction. The fourth conveyance roller pair 54 is movable in a width direction, which is perpendicular to the surface of the paper on which FIG. 1 is drawn. When collating (sorting) is selected, each of the sheets P transported to the second conveyance path K4 is transported while being shifted for a predetermined amount in the width direction by the fourth conveyance roller pair 54. Then, the ejection rollers 55 (a fifth conveyance roller pair) discharge the sheets P sequentially on the second output tray 72.

Referring to FIG. 2, a feeler 82 is disposed above the second output tray 72. The feeler 82 is rotatable around a support shaft disposed at an upper end thereof in FIG. 2, and the second output tray 72 is movable vertically in FIG. 2 with a position change mechanism. When a sensor disposed adjacent to the support shaft of the feeler 82 detects that a center portion (in the sheet conveyance direction) of the sheet P sequentially placed on the second output tray 72 is in contact with the feeler 82, a height of the sheets P on the second output tray 72 is recognized. In accordance with increases and decreases in the number of the sheets P on the second output tray 72, a vertical position of the second output tray 72 is adjusted. When the second output tray 72 is set at a lowest position in a movable range whereof, it is deemed that the number of the sheets P on the second output tray 72 is at an upper limit (the second output tray 72 is filled to its capacity). Then, the sheet processing apparatus 50 transmits a stop signal to a controller 60 of the image forming apparatus 1 to stop image forming operation. It is to be noted that the image forming apparatus 1 consecutively operates while a sequence of post-processing processes including the processes described above or later is performed in the sheet processing apparatus 50. Specifically, the image forming components such as the photoconductor drum 5 and the transfer roller 7 are driven idle even when the image forming processes on the photoconductor drum 5 are not performed.

When stapling is selected, the sheets P transported to the second conveyance path K4 are sequentially stacked on the internal tray 61 by the fourth conveyance roller pair 54 without being shifted. An alignment roller 64 is disposed above the internal tray 61. After a designated number of sheets P (a bundle of sheets) are stacked on a sheet mounting face of the internal tray 61, the alignment roller 64 moves to a position to contact the sheet P on the top on the sheet mounting face. As the alignment roller 64 rotates counterclockwise in FIG. 2, the multiple sheets P are moved to a fence 66. With this action, a trailing end of each of the multiple sheets P contacts the fence 66, and thus the multiple sheets P are aligned in the sheet conveyance direction.

Referring to FIG. 2, jogger fences 68 are disposed at both ends in the width direction of the internal tray 61. At that time, the jogger fences 68 move in the width direction to sandwich the sheets P on the internal tray 61, thereby aligning the sheets P in the width direction. Then, the stapler 90 staples the trailing end of the bundle of sheets P aligned in the sheet conveyance direction as well as the width direction.

After being stapled, the bundle of sheets P moves obliquely upward along a slope of the sheet mounting face of the internal tray 61 as a release claw 67 moves in the direction in which the bundle is discharged. Then, the ejection rollers 55 discharge the bundle to the second output tray 72.

When folding is selected, the sheet P is transported to the second conveyance path K4 and then switchbacked while the fourth conveyance roller pair 54 rotates in reverse with the trailing end of the sheet P nipped therein. Then, the sheet P is transported to the third conveyance path K5. Along the third conveyance path K5, conveyance roller pairs 56, 57, and 58 transport the sheet P to a position where a center position of the sheet P faces the center-folding blade 84. At that time, a leading end of the sheet P is in contact with a stopper 85, which is movable in the sheet conveyance direction with a slide mechanism. A designated number of sheets P is stacked at that position.

The sheet P is pressed at the position of the center-folding plate 86 and folded at the center position by the center-folding blade 84 that moves to the left in FIG. 2. Subsequently, the sheet P or bundle of sheets P is transported by a conveyance roller pair 59 and discharged to the third output tray 73.

Next, the fixing device 20 of the image forming apparatus 1 according to the present embodiment is described in further detail below. The fixing device 20 includes the fixing belt 21, a hollow metal pipe disposed to face an inner circumferential face of the fixing belt 21, a halogen heater (i.e., a heat source) disposed inside the hollow of the metal pipe, the pressure roller 22, a nip holder disposed inside the fixing belt 21, and first and second temperature sensors 28A and 28B (in FIG. 1, collectively represented by reference numeral "28") to detect a surface temperature of the pressure roller 22, and the like. The nip holder is pressed against the pressure roller 22 via the fixing belt 21, thereby defining a contact portion between the fixing belt 21 and the pressure roller 22 (i.e., a fixing nip).

The fixing belt 21 is a flexible endless belt and relatively thin. The fixing belt 21 rotates clockwise in FIG. 1. The fixing belt 21 includes an elastic layer and a release layer sequentially overlying a base material, and an entire thickness of the fixing belt 21 is 1 mm or smaller.

Output from the halogen heater disposed inside the fixing belt 21 is controlled according to surface temperature of the fixing belt 21 detected by a thermistor opposed to the surface of the fixing belt 21. The fixing belt 21 is heated to a desired temperature (i.e., a fixing temperature) via the metal pipe by radiant heat from the halogen heater. Heat is transmitted from the surface of the fixing belt 21 to the toner image on the sheet P, thereby fixing the toner image on the sheet P.

The pressure roller 22 serving as a pressure rotator includes a hollow metal core, made of stainless steel or aluminum, and an elastic layer made of foam silicone rubber or silicone rubber in one embodiment. The pressure roller 22 rotates counterclockwise in FIG. 1.

Figure 3:
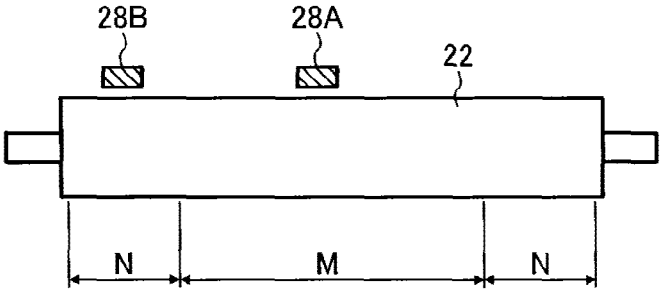
FIG. 3 is a schematic view of a pressure roller of a fixing device according to an embodiment.

In the present embodiment, as illustrated in FIG. 3, the fixing device 20 includes the two temperature sensors, namely, the first and second temperature sensors 28A and 28B, disposed adjacent to a center portion and an end portion of the pressure roller 22 in the width direction to detect the surface temperature of the pressure roller 22. The first temperature sensor 28A is to detect the temperature of the center portion of the pressure roller 22 in the width direction, and the second temperature sensor 28B is to detect the temperature of the end portion of the pressure roller 22 in the width direction. For example, when small size sheets P are successively fed, the first temperature sensor 28A detects the temperature of the pressure roller 22 corresponding to a small sheet range M, and the second temperature sensor 28B detects the temperature of the pressure roller 22 corresponding to a non-sheet range N. Then, the controller 60 compares the detection result generated by the first temperature sensor 28A with that generated by the second temperature sensor 28B, and determines whether or not the non-sheet range N is overheated. When it is determined that the non-sheet range N is overheated, the image forming apparatus 1 enters a fixing temperature adjustment mode, in which an interval between large size sheets P is set to an increased interval. This adjustment is effective to suppress the occurrence of defective fixing such as hot offset in the end portions in the width direction (corresponding to the non-sheet range N in the case of small sheet size) when images are fixed on large size sheets. In particular, the fixing device 20 according to the present embodiment is of energy-saving type having an enhance efficiency in transmitting heat from the heat source (heater) to the fixing rotator, and the amount of heat diffused in the width direction of the fixing rotator is smaller. Accordingly, the possibility of overheat in the non-sheet range N is higher. Thus, the temperature control is effective. It is to be noted that, control of the power supply 35 in the fixing temperature adjustment mode is described later with reference to FIG. 6.

It is to be noted that, although the first and second temperature sensors 28A and 28B are respectively disposed to face the center portion and the end portion of the pressure roller 22 in the width direction to determine temperature conditions of the non-sheet range N of the fixing device 20 in the present embodiment, in another embodiments, temperature sensors are respectively disposed to face the center portion and the end portion of the fixing belt 21 in the width direction to determine temperature conditions of the non-sheet range N of the fixing device 20.

Additionally, although the descriptions above concern the fixing device 20 including the fixing belt 21, the pressure roller 22, and the halogen heater, the present embodiment can adapt to various types of fixing devices. For example, the present embodiment can adapt to a fixing device employing a fixing roller, a fixing device employing a pressure belt, and a fixing device employing a heater including an excitation coil, a heating resistor, or the like.

Next, the configuration and operation of the image forming apparatus 1 according to the present embodiment are described in further detail below.

Figure 4A:
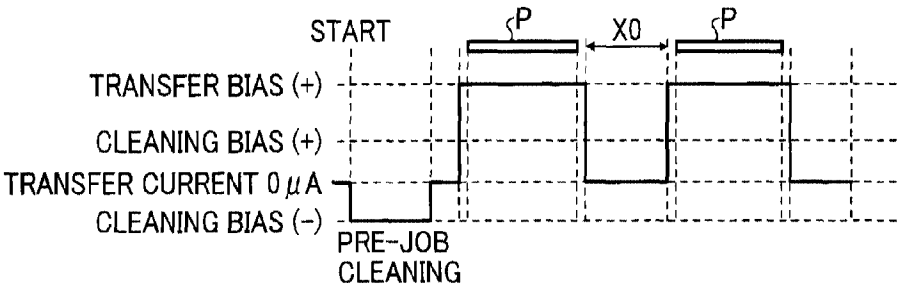
FIGS. 4A, 4B, and 4C are timing charts of control of a power supply to apply bias to a transfer roller according to a first embodiment.
Figure 4B:
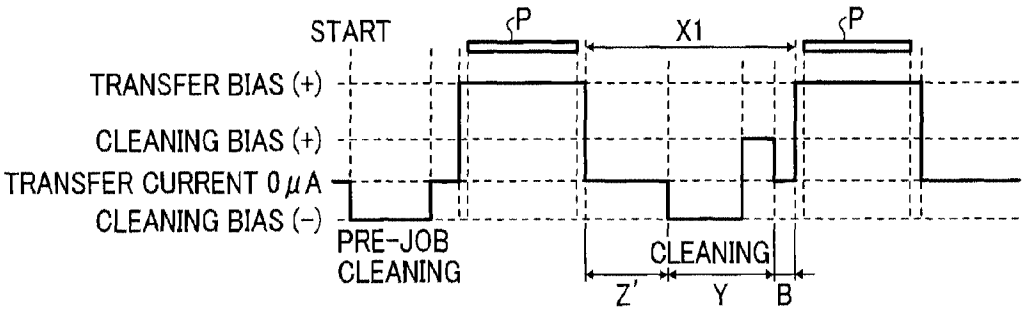
Figure 4C:
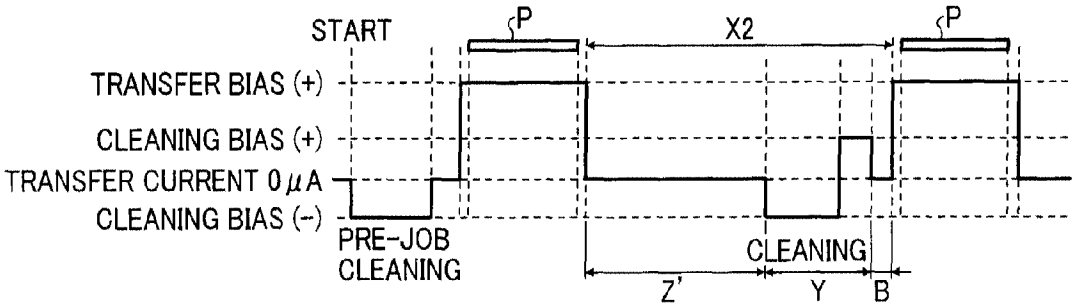

FIGS. 4A, 4B, and 4C are timing charts of control of the power supply 35 for the transfer roller 7 when the multiple sheets P are successively fed (hereinafter "successive sheet feeding" or "continuous sheet feeding").

The power supply 35 (illustrated in FIG. 1) serving as the bias application device is to apply, in addition to the above-described transfer bias, the cleaning bias to the transfer roller 7 to remove toner adhering to the transfer roller 7. Specifically, the power supply 35 is capable of changing the value of transfer current supplied to the transfer roller 7. More specifically, the controller 60 including a central processing unit (CPU), a random access memory (RAM), a read only memory (ROM), and the like changes the value of transferring current applied to the transfer roller 7 by the power supply 35.

It is assumed that hereinafter "X" represents a sheet feeding interval (an interval between sheets, which is a variable in milliseconds) from when the sheet P is sent out from the transfer nip to when the subsequent sheet P is nipped therein while the multiple sheets P are successively fed (successive sheet feeding) in a state in which the photoconductor drum 5 (the image bearer) and the transfer roller 7 are driven, and "Y" is a fixed value (in milliseconds) representing a duration of application of the cleaning bias, which is hereinafter referred to as "cleaning bias application time Y". The controller 60 controls the power supply 35 so that application of the cleaning bias to the transfer rotator (i.e., transfer roller 7) is executed in that sheet feeding interval X when a difference expressed as X−Y exceeds a threshold A. The sheet feeding interval X is changed according to predetermined conditions, and the threshold A (in milliseconds) is predetermined.

The threshold A and the fixed value serving as the cleaning bias application time Y are stored in a memory of the controller 60. The CPU of the controller 60 computes the difference expressed as X−Y.

In FIGS. 4B and 4C, reference character "X1" and "X2" represent sheet feeding intervals that are relatively long (>Y+A) and satisfy X−Y>A. When the sheets P are fed at the sheet feeding interval X1 or X2, the cleaning bias application is executed for the cleaning bias application time Y within the sheet feeding interval X1 or X2. In other words, when the above-mentioned formula is satisfied, regardless of the length of the sheet feeding interval X, the cleaning bias application is executed for an identical or similar time period. Then, out of the sheet feeding interval X, a non-image area bias is applied for time Z (=X−Y, hereinafter "non-image bias application time Z") except the cleaning bias application time Y.

By contrast, reference character "X0" in FIG. 4A represents a sheet feeding interval that is shorter (≤Y+A). As illustrated in FIG. 4A, when the above-mentioned formula is not satisfied, the cleaning bias application is not executed in the sheet feeding interval X0.

It is to be noted that, when the application time of cleaning bias is divided into multiple number of times in one sheet feeding interval X, the cleaning bias application time Y in the above-mentioned formula means a total time in which the cleaning bias is applied within the sheet feeding interval X.

The threshold A is preliminarily determined considering the possibility of deviation in position of the sheet P transported to the transfer nip, a switching time of the bias applied to the transfer roller 7, and the like. If the threshold A is extremely small, it is possible that the timing at which the sheet P is sent out and the timing at which the sheet P is fed into the transfer nip coincide with the cleaning bias application, and image output is not in time. If the threshold A is extremely large, it is possible that frequency of cleaning bias application is lowered. Accordingly, the threshold A is set properly.

As described above, in the present embodiment, even when the sheet feeding interval X is long, adhesion of toner to the back side and the edge face of the sheet P is suppressed since the cleaning bias is applied to the transfer roller 7, thereby transferring the toner from the transfer roller 7 again onto the photoconductor drum 5 in the sheet feeding interval X. Additionally, since the cleaning bias application is executed only when the cleaning bias application time Y is available within the sheet feeding interval X, the sheet feeding interval X is not increased for the cleaning bias application. Accordingly, productivity in successive sheet feeding is not degraded by the cleaning bias application.

Yet additionally, since the cleaning bias application time Y is a fixed value in the first embodiment, the cleaning bias application time Y is not increased even when the sheet feeding interval X is longer. This is advantageous in alleviating damage (electrical hazard), caused by the cleaning bias, given to the photoconductor drum 5, which directly contacts the transfer roller 7 during intervals between sheets P. Consequently, creation of substandard images with streaky image density unevenness is inhibited.

It is to be noted that, as illustrated in FIG. 4A, when the sheet feeding interval X0 is short, the above-described cleaning of the transfer roller 7 is not performed. When the sheet feeding interval X is short (X0 in FIG. 4A), the amount of toner transferred from the photoconductor drum 5 to the transfer roller 7 in intervals between the sheets P is small, and the small amount of toner adhering to the transfer roller 7 moves to the subsequent sheet P. The amount of toner transferred onto the subsequent sheet P at that time is not noticeable. Thus, the transfer roller 7 is cleaned (i.e., self-cleaning).

The cleaning bias application time Y (fixed value) is set to a time period during which the transfer roller 7 makes one revolution (a complete turn) or rotates further. The transfer roller 7 is cleaned entirely in the circumferential direction (in the direction of arc) by applying the cleaning bias for the period equivalent to one revolution or longer. However, it is possible that toner or the like is not thoroughly removed from the transfer roller 7 by application of cleaning bias for the period equivalent to one revolution. Therefore, in the present embodiment, the cleaning bias is applied to the transfer roller 7 for a period equivalent to 3.9 revolutions of the transfer roller 7. Specifically, a first cleaning bias (CLEANING BIAS 1 in FIGS. 8 and 9) in negative polarity is applied thereto for a period equivalent to three revolutions, and a second cleaning bias (CLEANING BIAS Y2 in FIGS. 8 and 9) in positive polarity is applied thereto for a period equivalent to 0.9 revolution.

Although cleaning effects are enhanced when the application time (Y, fixed value) of those cleaning biases is set to a relatively long duration, the execution of cleaning bias application, which is determined according to the formula X−Y>A, is less likely to occur. Additionally, excessive application of those cleaning biases may damage the photoconductor drum 5. Accordingly, the application time thereof is determined considering the various factors.

Additionally, in the cleaning bias application according to the first embodiment, referring to FIGS. 4B and 4C, after the first cleaning bias opposite in polarity (negative) to the transfer bias (positive) is applied to the transfer roller 7, the second cleaning bias (positive) identical in polarity to the transfer bias is applied to the transfer roller 7.

This operation is effective since the toner adhering to the non-image areas (background) of the photoconductor drum 5 includes a small amount of reversely charged toner in addition to normally charged toner, and both are transferred onto the transfer roller 7 in the sheet feeding intervals X. The normally charged toner (having negative charges) is returned to the photoconductor drum 5 by applying the negative first cleaning bias to the transfer roller 7. By contrast, the reversely charged toner (having positive charges) is returned to the photoconductor drum 5 by applying the positive second cleaning bias to the transfer roller 7. With this operation, the toner adhering to the transfer roller 7 can be fully removed.

It is to be noted that, referring to FIGS. 4B and 4C, the cleaning bias is smaller in absolute value than the transfer bias (applied in the range of the sheet P in FIGS. 4A through 4C).

With this setting, damage given to the photoconductor drum 5 by the cleaning bias is reduced.

Referring to FIGS. 4B and 4C, when the cleaning bias application is executed in the sheet feeding interval X according to the above-mentioned formula, the power supply 35 to apply the bias to the transfer roller 7 is controlled not to start cleaning bias application immediately after the start of the sheet feeding interval X but to end the cleaning bias application immediately before the end of that sheet feeding interval X (or prior to a margin B before the end of the sheet feeding interval X). That is, the controller 60 controls the power supply 35 to execute the cleaning bias application not a former part of the sheet feeding interval X but a latter part of the sheet feeding interval X considering the following.

In a case where the sheet feeding interval X is long and the cleaning bias application is executed immediately after the start of the sheet feeding interval X, it is possible that the transfer roller 7 is again soiled with toner before the sheet feeding interval X ends.

Specifically, a time Z' from the start of the sheet feeding interval X to the start of application of the cleaning bias is expressed as:

$$Z' = X - Y - B$$
$$= Z - B$$

wherein X represents the sheet feeding interval (variable), Y represents the cleaning bias application time (fixed value), B represents the margin, and Z represents the non-image bias application time. In this formula, the margin B (in milliseconds) is either a fixed value or a multiplication of the sheet feeding interval X with a predetermined coefficient.

With this control, the transfer roller 7 is efficiently cleaned in the sheet feeding interval X. It is to be noted that, in the present embodiment, the non-image area bias is applied to the transfer roller 7 also in the period corresponding to the margin B.

Additionally with reference to FIGS. 4B and 4C, in the present embodiment, the power supply 35 is controlled to set the value of the non-image area bias, which is the transfer current flowing to the transfer roller 7 except the period in which the cleaning bias application is executed out of the sheet feeding interval X, to 0 μA. In FIG. 4A, similarly, when the cleaning bias application is not executed, the value of transfer current flowing to the transfer roller 7 is set to 0

μA except the period of transfer process in which the transfer bias is applied to the transfer roller 7.

Specifically, If, in the period except the cleaning bias application, the transfer current (non-image area bias) is set to a large value in positive side, the normally charged toner (having negative charges) is attracted to the transfer roller 7. By contrast, if the transfer current (non-image area bias) is set to a large value in negative side in the period except the cleaning bias application, the reversely charged toner (having positive charges) is attracted to the transfer roller 7. Then, it is possible that soiling of the transfer roller 7 accumulates as the sheet feeding interval X increases. Therefore, to efficiently remove toner from the transfer roller 7, the transfer current of 0 μA (non-image area bias) is applied to the transfer roller 7 immediately after the start of the sheet feeding interval X, and subsequently the predetermined cleaning bias is applied to the transfer roller 7. Thus, adhesion of toner to the back side and the edge face of the sheet P is suppressed.

It is to be noted that, in the first embodiment, before a printing job, specifically, before the transfer process onto the sheet P is executed, the power supply 35 applies a cleaning bias to the transfer roller 7 as pre-job cleaning.

Specifically, immediately after the start of the image forming operation (printing), the power supply 35 applies a pre-job cleaning bias to the transfer roller 7 for a period equivalent to one revolution of the transfer roller 7 or longer. The pre-transfer cleaning bias is smaller in absolute value than the transfer bias and opposite in polarity to the transfer bias.

With this operation, even if floating toner adheres to the transfer roller 7 while the image forming apparatus 1 is left unused before image formation is started, such toner is removed from the transfer roller 7 before the transfer process.

As described above, the controller 60 sets and changes the length of the sheet feeding interval X in successive sheet feeding in accordance with the predetermined conditions in the image forming apparatus 1.

The conditions according to which sheet feeding interval is determined in the present embodiment include at least one of an operating condition of the sheet processing apparatus 50 to process the sheets P output from the image forming apparatus 1, the temperature conditions of the non-sheet range N in the fixing device 20, recognized according to detection results generated by the first and second temperature sensors 28A and 28B, and temperature around the photoconductor drum 5 detected by the temperature and humidity sensor 48.

Specifically, similar to typical image forming apparatuses, in the image forming apparatus 1, an interval between feeding of a single sheet and another sheet or an interval between one copy (one set) of multiple sheets and another copy of the multiple sheets is increased when the sheet processing apparatus 50 performs post-processing, such as stapling, folding, or punching, of the sheet or a bundle of sheets. That is, the sheet feeding interval X is increased to secure sufficient time for the sheet processing apparatus 50 to perform the post-processing of sheets.

Figure 5:
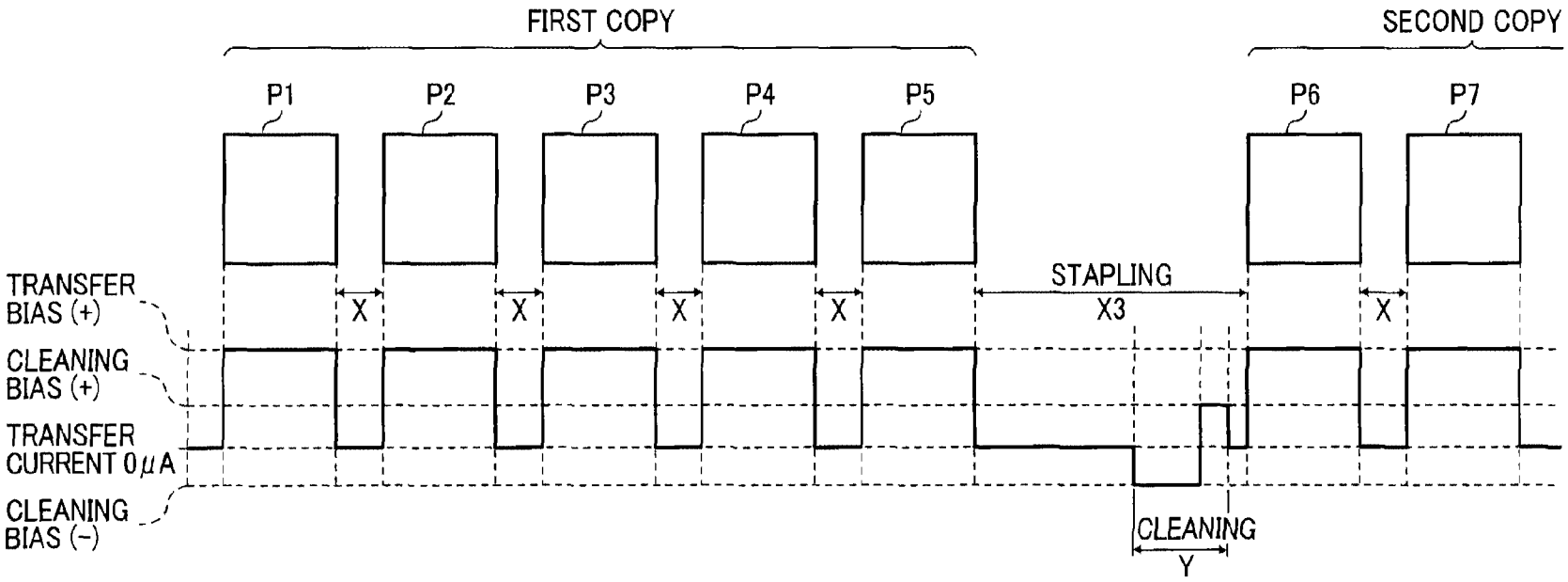
FIG. 5 is a timing chart of control of the power supply to apply bias to the transfer roller according to an embodiment, for a case where post-processing of sheets is performed.

FIG. 5 is a timing chart of control of the power supply 35 for the transfer roller 7 when the sheet processing apparatus 50 staples multiple bundles (i.e., multiple copies) each including five sheets P.

In this case, the sheet feeding interval X between the first copy including sheets P1 through P5 and the second copy including the sheets P6 through P10 is set to the increased length of time (sheet feeding interval X3 in FIG. 5), and the cleaning bias application is executed for the fixed time (Y) in a latter part of the sheet feeding interval X3.

Additionally, as mentioned above, in the image forming apparatus 1 according to the first embodiment, when the controller 60 recognizes the overheating of the non-sheet range N after successive feeding of small size sheets, the image forming apparatus 1 enters the fixing temperature adjustment mode before a large size sheet is subsequently fed. Then, the sheet feeding interval X is set to the increased length of time. The fixing temperature adjustment mode is to secure time to equalize the distribution of temperature in the fixing rotator in the width direction.

Figure 6:
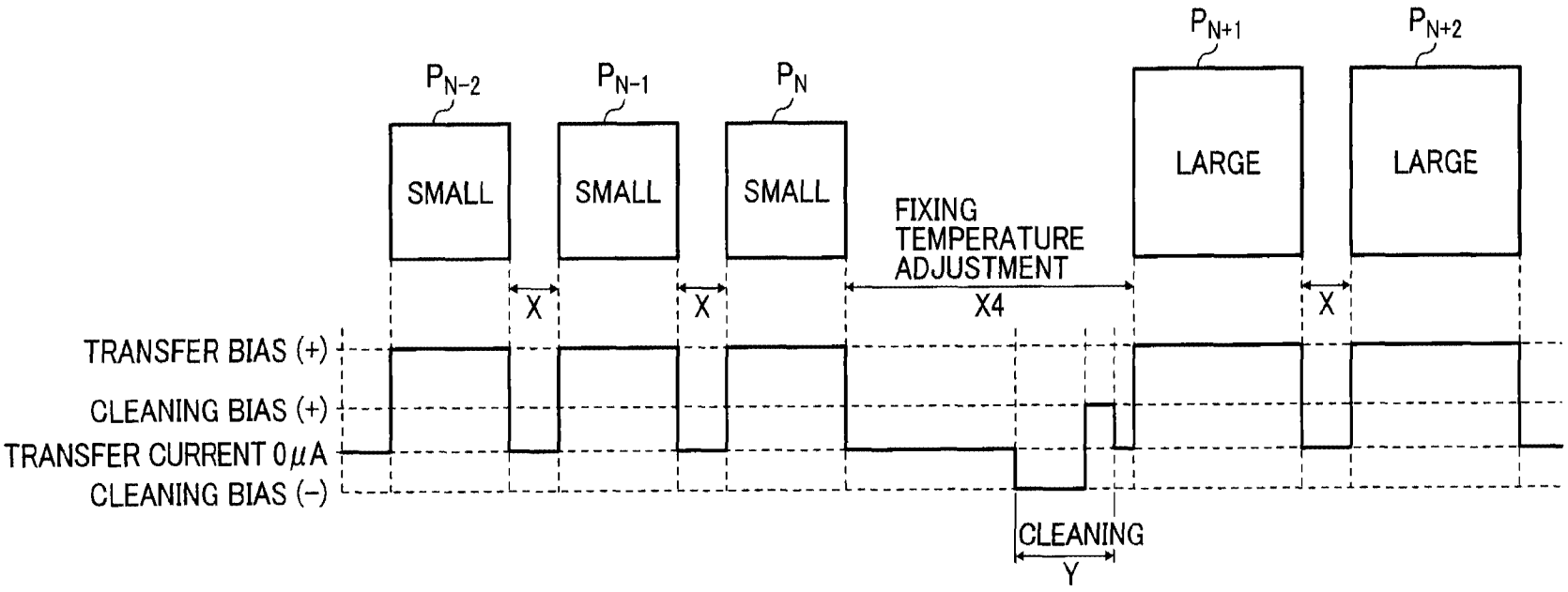
FIG. 6 is a timing chart of control of the power supply to apply bias to the transfer roller according to an embodiment, when overheating of a non-sheet area of a fixing device is recognized.

FIG. 6 is a timing chart of control of the power supply 35 for the transfer roller 7 when the overheating of the non-sheet area N of the fixing device 20 is recognized.

It is assumed that, out of the multiple sheets $P_{N-2}$ through $P_{N+2}$, successively fed to the transfer nip, the sheets $P_{N-2}$ through $P_N$ are small size sheets and the sheets $P_N$ through $P_{N+2}$ are large size sheets. In this case, the sheet feeding interval X after successive feeding of small size sheets $P_{N-2}$ through $P_N$ and before feeding of the large size sheet $P_{N+1}$ is set to the increased length of time (sheet feeding interval X4 in FIG. 6), the cleaning bias application is executed for the fixed time (Y) in a latter part of the sheet feeding interval X4.

Additionally, the image forming apparatus 1 illustrated in FIG. 1 includes the temperature and humidity sensor 48 serving as a temperature detector to detect a temperature adjacent to the photoconductor drum 5. The temperature and humidity sensor 48 serves as an environment detector, described later, as well. When the temperature and humidity sensor 48 detects a temperature at or higher than a threshold, the controller 60 sets the image forming apparatus 1 in a low-productivity mode, in which each sheet feeding interval X during successive sheet feeding is set to an increased length of time (sheet feeding interval X5 in FIG. 7), to restrict temperature rise in the image forming apparatus 1. If an interior (adjacent to the photoconductor drum 5 in particular) of the image forming apparatus 1 is overheated, there arises a risk of fusing of toner and adhesion of fused toner to the image forming components. The present embodiment particularly addresses this inconvenience since the toner having a lower melting point is used.

Figure 7:
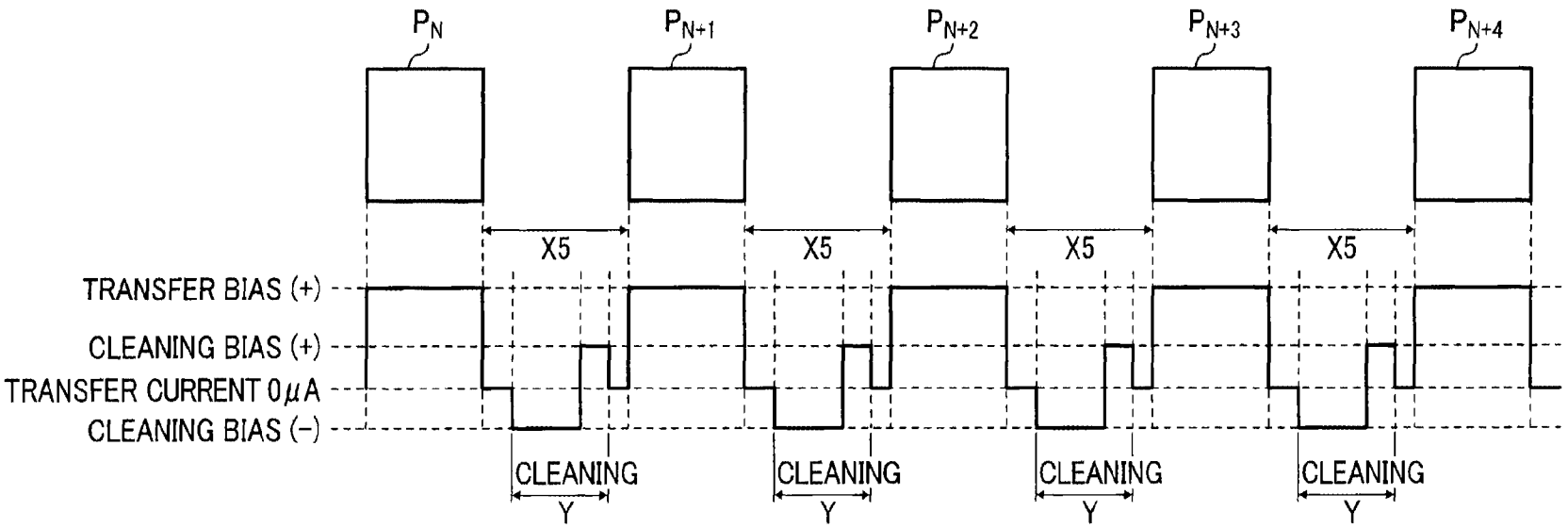
FIG. 7 is a timing chart of control of the power supply to apply bias to the transfer roller according to an embodiment, for a case where temperature adjacent to the photoconductor drum rises.

FIG. 7 is a timing chart of control of the power supply 35 for the transfer roller 7 in the low-productivity mode due to the temperature rise adjacent to the photoconductor drum 5.

In the low-productivity mode, each sheet feeding interval X during successive feeding of sheets $P_N$ through $P_{N+4}$ in FIG. 7 is set to the increased length of time (sheet feeding interval X5 in FIG. 7). Similar to the control described with reference to FIGS. 4B through 6, the cleaning bias application is executed for the fixed time (Y) in a latter part of each sheet feeding interval X5.

It is to be noted that the sheet feeding interval X is also changed depending on sheet type as well (i.e., thickness, smoothness, of the like of the sheet). For example, when the sheet P is thicker (such as cardboard), the sheet feeding interval X is typically set to an increased length of time, and control of the power supply 35 in such a case can be similar to that described above.

Additionally, the conditions under which the sheet feeding interval X is increased are not limited to those described above. Alternatively, for example, the sheet feeding interval X is increased when duplex printing is executed.

Further, a sheet conveyance speed at which the sheet P is transported to the transfer nip (identical or similar to the process speed defined as the linear velocity of the photoconductor drum 5) is variable, and the power supply 35 is controlled to adjust the magnitude of the cleaning bias in accordance with the sheet conveyance speed.

FIG. 8 is a table of correction coefficients of the first cleaning bias and the second cleaning bias for each process speed when the process speed is changed in three stages as one example.

In the case of FIG. 8, a standard process speed is 260 mm/s, and the correction coefficient at that time is 100. When the process speed is reduced from the standard process speed, the magnitude of the cleaning bias is reduced at the rate of the correction coefficient shown in FIG. 8. For example, when the process speed is set at 150 mm/s, the magnitude of the first cleaning bias is 83/100 of the first cleaning bias for the standard process speed of 260 mm/s.

The magnitude of the cleaning bias is thus adjusted because the bias relative to the value of transfer current changes as the process speed changes. The bias (i.e., current value) is set properly corresponding to the process speed. By adjusting the cleaning bias as described above, the transfer roller 7 can be cleaned reliably even when the process speed changes. It is to be noted that the process peed is changed, for example, to maintain the fixing performance and gloss of the image with a high accuracy even when the property (such as thickness or smoothness) of the sheet P is different.

In yet another embodiment, the power supply 35 for the transfer roller 7 is controlled to adjust the magnitude of the cleaning bias according to a detection result such as an absolute humidity detected by the temperature and humidity sensor 48, serving as the environment detector.

FIG. 9 is a table of example settings of the first cleaning bias and the second cleaning bias in accordance with the absolute humidity.

The control according to the table shown in FIG. 9 is effective because the occurrence of soil with toner of the transfer roller 7 is affected largely by environments. The occurrence of soil with toner tends to increase as the absolute humidity increases. Accordingly, as illustrated in FIG. 9, when the absolute humidity is higher, the absolute value of output of cleaning bias (i.e., the transfer current value) is set to a higher value to enhance performance of cleaning of the transfer roller 7.

Descriptions are given below of effects of the above-described embodiments confirmed by an experiment executed by the inventor, with reference to FIG. 10.

Figure 10:
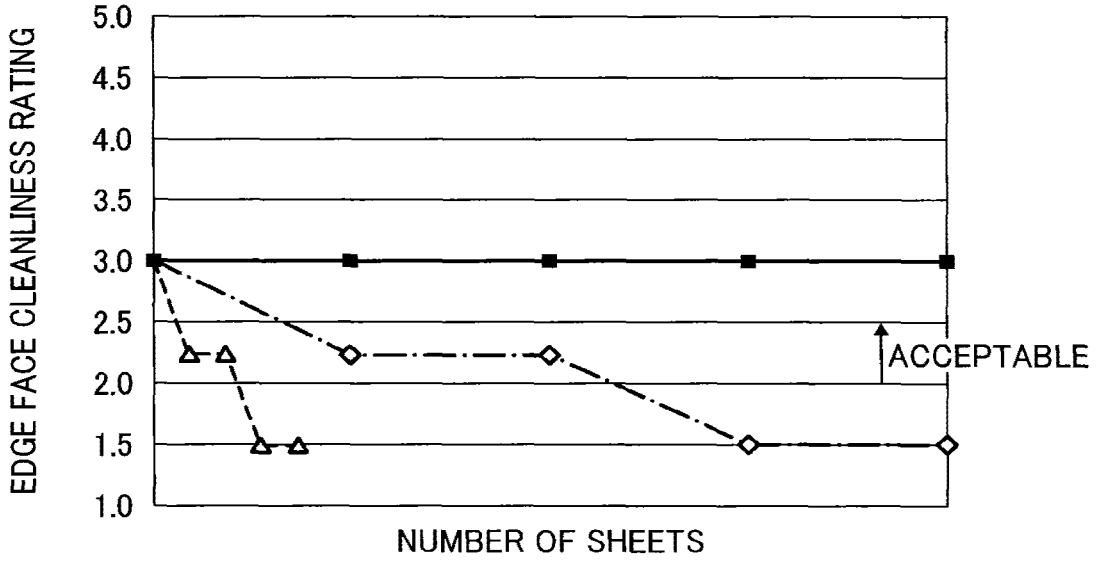
FIG. 10 is a graph of experimentally obtained changes over time of cleanliness rating (indicating the degree of adhesion of toner) of edge face of sheets.

FIG. 10 is a graph of experimentally obtained changes over time of cleanliness rating (indicating the degree of adhesion of toner) of the edge face of the sheet P.

In FIG. 10, the abscissa represents the number of sheets fed to the transfer nip, and The ordinate in FIG. 10 represents the edge face cleanliness rating, and level 2 means that the soil of the edge face of the sheet P is acceptable. The level ascends as the edge face cleanliness is improved, and level 5 means that the edge face is not soiled. The edge face of the sheet P is likely to be soiled with toner in the image forming apparatus under 1 a temperature of 27° C. and a humidity of 80%, and the experiment was performed under these conditions. Additionally, a transfer roller at or near its end of operational life was used as the transfer roller 7, and the printing speed was set to 30 copies per minute (CPM).

FIG. 10 includes three different graphs, obtained under different conditions:

1) a graph indicated by alternate long and short dashed lines, representing the results when the sheet feeding interval was set to a short length of time (X1 in FIG. 4B) and the transfer roller cleaning was not executed;

2) a graph indicated by broken lines, representing the results when the sheet feeding interval was set to an increased length of time (X3 in FIG. 5, about 10 seconds) and the transfer roller cleaning was not executed; and 3) a graph indicated by a solid line, representing the results when the sheet feeding interval was set to an increased length of time (X3 in FIG. 5, about 10 seconds) and the transfer roller cleaning was executed according to the first embodiment.

According to the results illustrated in FIG. 10, it is confirmed that the transfer roller 7 is efficiently cleaned in intervals between sheets and the soil with toner is alleviated by controlling the power supply 35 to supply bias thereto according to the first embodiment.

As described above, in the first embodiment, the controller 60 controls the power supply 35 so that, when the difference expressed as X−Y (Y is the fixed value representing the cleaning bias application time and X is the variable representing the sheet feeding interval, changed according to the predetermined conditions) exceeds the threshold A during successive sheet feeding, and cleaning of the transfer roller 7 is executed during that sheet feeding interval.

In other words, when the sheet feeding interval X between feeding of a sheet to the transfer nip and feeding of a subsequent sheet thereto during successive sheet feeding, which is changed according to the predetermined condition, exceeds a threshold, the non-image area bias is applied to the transfer rotator for the time (non-image bias application time Z) out of the sheet feeding interval X. Then, the cleaning bias is applied for the time Y expressed as X−Z, and the non-image bias application time Z increases as the sheet feeding interval X increases.

This control efficiently suppress soil of the back side and the edge face of the sheet P transported to the transfer nip, resulting from the toner transferred from the photoconductor drum 5 and adhering to the transfer roller 7 while inhibiting acceleration of degradation of the photoconductor drum 5 (the image bearer) caused by the cleaning bias and further inhibiting reduction in productivity in successive sheet feeding resulting from the cleaning bias application.

Second Embodiment

A second embodiment is described below with reference to FIGS. 11A, 11B, and 11C.

Figure 11A:
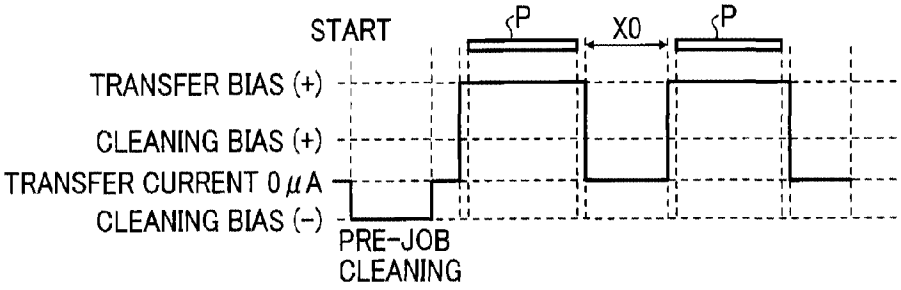
FIGS. 11A, 11B, and 11C are timing charts of control of a power supply for a transfer roller according to a second embodiment.
Figure 11B:
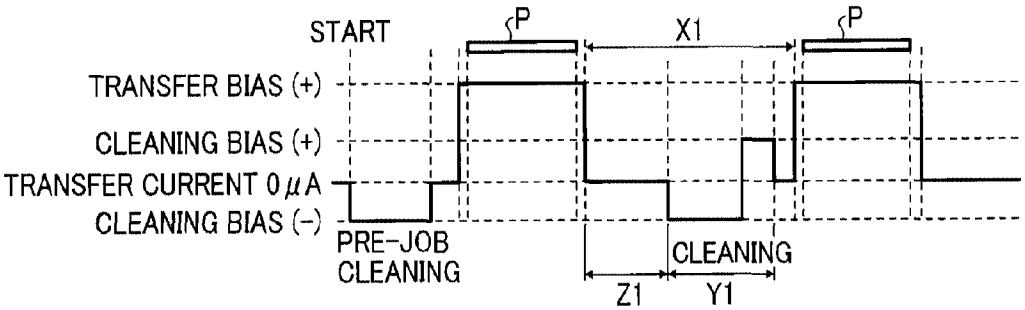
Figure 11C:
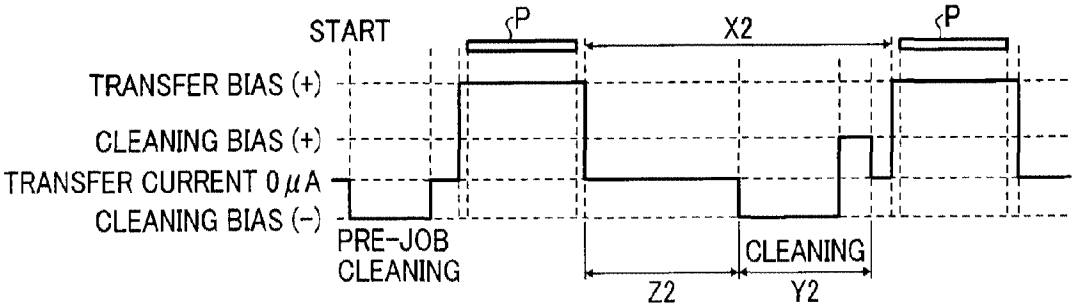

FIGS. 11A, 11B, and 11C are timing charts of control of the power supply 35 for the transfer roller 7 according to the second embodiment. FIGS. 11A, 11B, and 11C respectively correspond to FIGS. 4A, 4B, and 4C.

In the second embodiment, the cleaning bias application time Y is a variable, which is different from the above-described first embodiment in which the cleaning bias application time is a fixed value.

Similar to the above-described first embodiment, in the second embodiment, the power supply 35 (illustrated in FIG. 1) serves as the bias application device to apply the transfer bias, the cleaning bias, and the non-image bias to the transfer roller 7.

Similar to the above-described first embodiment, in the second embodiment, the sheet feeding interval X represents a duration from when a sheet P is sent out from the transfer nip to when a subsequent sheet P is nipped therein while multiple sheets P are successively fed to the transfer nip in the state in which the photoconductor drum 5 (the image bearer) is driven, and the sheet feeding interval is changed according to the predetermined condition. Additionally, when the sheet feeding interval X exceeds a predetermined threshold, application of the non-image area bias is executed for the non-image bias application time Z, out of the sheet feeding interval X, and application of the cleaning bias is executed for the time expressed as X−Z. In the second embodiment, similarly, the non-image bias application time Z is set to an increased time as the sheet feeding interval X increases.

If the cleaning bias application time Y is increased by the amount equal to the increase in the sheet feeding interval X changed according to the predetermined condition, the is a risk that damage (electrical hazard) given by the cleaning bias to the photoconductor drum 5, which directly contacts the transfer roller 7 during intervals between sheets P, increases accordingly. In this case, the possibility of image failure, such as streaky image density unevenness, increases.

By contrast, in the second embodiment, the non-image bias application time Z is increased as the sheet feeding interval X increases similar to the above-described first embodiment. Accordingly, even if the sheet feeding interval X becomes longer, the cleaning bias application time Y (=X−Z) is not made too long. Thus, the damage to the photoconductor drum 5 can be suppressed.

In the second embodiment, the cleaning bias application time Y is changed in accordance with the sheet feeding interval X, but not increased by the amount equal to the increase in the sheet feeding interval X. Specifically, referring to FIGS. 11B and 11C, when the cleaning bias application is to be executed and the sheet feeding interval X is set to the relatively long sheet feeding interval X2, the cleaning bias application time Y is set to a cleaning bias application time Y2 longer than a cleaning bias application time Y1 for the case in which the sheet feeding interval X is set to the sheet feeding interval X1 shorter than the sheet feeding interval X2. Adjusting the cleaning bias application time Y in accordance with the sheet feeding interval X is advantageous in improving cleaning of the transfer roller 7.

More specifically, it is assumed that "Y0" represents a shortest application time of the cleaning bias applied to the transfer roller 7 (shortest cleaning bias application time Y0 in milliseconds) to secure cleaning of the transfer roller 7, and a remaining time (except the shortest cleaning bias application time Y0 in the sheet feeding interval X, changed according to the predetermined conditions, is expressed as "X−Y0". The power supply 35 is controlled such that the cleaning bias application is executed during the sheet feeding interval X when the time X−Y0 exceeds a predetermined threshold A' (X−Y0>A').

In FIG. 11B, the sheets P are fed at the sheet feeding interval X1 that is sufficiently long and satisfies X−Y0>A'. That is, X1>Y0+A' is satisfied in FIG. 11B. In this case, cleaning bias application is executed for the cleaning bias application time Y1 within the sheet feeding interval X1. Similarly, in FIG. 11C, the sheets P are fed at the sheet feeding interval X2 (>X1>Y0+A'), which satisfies the above-described relation (X2>Y0+A'). In this case, cleaning bias application is executed for the cleaning bias application time Y2 (>Y1) in the sheet feeding interval X2.

By contrast, reference character "X0" in FIG. 11A represents a sheet feeding interval that is shorter and does not satisfies the above-described relation (X0≤Y0+A'). In this case, the cleaning bias application is not executed in the sheet feeding interval X0.

In the setting in which the time Z is a fixed value and the cleaning bias application time Y is elongated by the amount equal to the increase in the sheet feeding interval X, the cleaning bias application time Y is expressed as Y2=Y1+(X2−X1). As described above, in this setting, there arises the risk that the cleaning bias application time Y2 is excessively long when the sheet feeding interval is long. Accordingly, the risk of damage to the photoconductor drum 5 resulting from the cleaning bias increases.

By contrast, in the second embodiment, the non-image bias application time Z is set to an increased time as the sheet feeding interval X increases. That is, as illustrated in FIGS. 11B and 11C, the non-image bias application time Z2 (>Z1) for the case of the longer sheet feeding interval X2 (>X1) is set to a longer length of time than the non-image bias application time Z1 for the shorter sheet feeding interval X1. Therefore, even in the case of the long sheet feeding interval X2, the cleaning bias application time Y2 is not too long. Thus, damage given to the photoconductor drum 5 by the cleaning bias is reduced while securing cleaning performance.

The shortest cleaning bias application time Y0 is equal to or longer than a time period during which the transfer roller 7 (transfer rotator) makes one revolution. The cleaning bias application time Y1 or Y2 for the increased sheet feeding interval X1 or X2 is equal to or longer than the shortest cleaning bias application time Y0. The transfer roller 7 is cleaned entirely in the circumferential direction (in the direction of arc) by applying the cleaning bias for the period equivalent to one revolution or longer.

As described above, also in the second embodiment, when the sheet feeding interval X, which is changed according to the predetermined condition and means an interval between feeding of a sheet to the transfer nip and feeding of a subsequent sheet thereto during successive sheet feeding, exceeds a threshold, the non-image are bias is applied to the transfer rotator for the time Z (non-image bias application time) out of the sheet feeding interval X. Then, the cleaning bias is applied for the time Y (=X−Z), and the non-image bias application time Z increases as the sheet feeding interval X increases. This control efficiently suppress soil of the back side and the edge face of the sheet P transported to the transfer nip, resulting from the toner transferred from the photoconductor drum 5 and adhering to the transfer roller 7 while inhibiting acceleration of degradation of the photoconductor drum 5 (the image bearer) caused by the cleaning bias and further inhibiting reduction in productivity in successive sheet feeding resulting from the cleaning bias application.

It is to be noted that, although the description above concerns the monochrome or single-color image forming apparatus 1 that includes the single image forming unit 4 including the single photoconductor drum 5, the features of the above-described embodiments can adapt to multicolor image forming apparatuses including multiple photoconductor drums each corresponding to a different color toner.

Additionally, in the description above, the features of the embodiments are applied to the image forming apparatus 1 in which the toner image is transferred from the photoconductor drum 5 serving as the image bearer directly onto the sheet P. Alternatively, the features of the embodiments can adapt to image forming apparatuses to transfer a toner image from a photoconductive belt serving as an image bearer onto a sheet and image forming apparatuses to transfer a toner image from an intermediate transfer belt or an intermediate transfer drum serving as an image bearer onto a sheet.

Additionally, although the description above concerns the image forming apparatus 1 employing the transfer roller 7 as the transfer rotator, the features of the embodiments can adapt to image forming apparatuses in which a transfer belt or a secondary transfer roller is used as the transfer rotator.

In such configurations, effects similar to those attained by the embodiments are also attained.

Figure 12A:
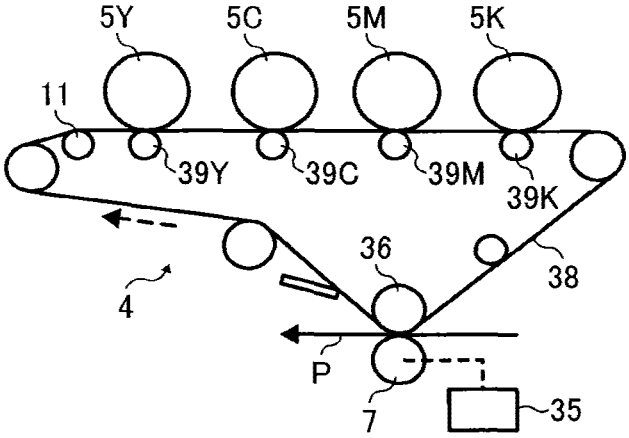
FIG. 12A is a schematic view that illustrates a main part of a multicolor image forming apparatus according to a variation.
Figure 12B:
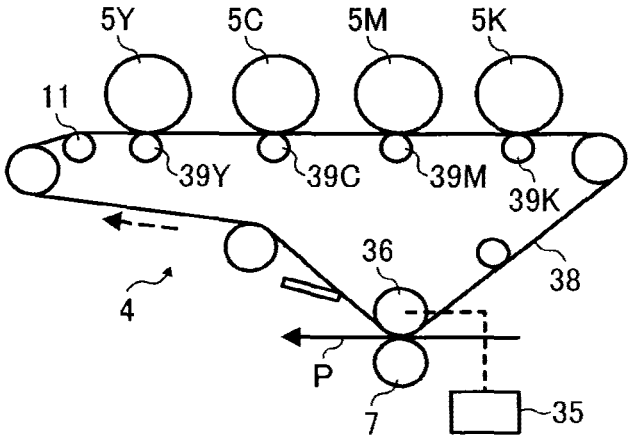
FIG. 12B is a schematic view that illustrates a main part of a multicolor image forming apparatus according to another variation.

Each of FIGS. 12A and 12B is a schematic view illustrating a main part of a multicolor image forming apparatus in which the image forming unit 4 includes multiple photoconductor drums 5 (5Y, 5M, 5C, and 5K). Each of the image forming apparatus illustrated in FIGS. 12A and 12B includes primary transfer rollers 39Y, 39M, 39C, and 39K (collectively "primary transfer rollers 39") and an intermediate transfer belt 38 serving as the image bearer. The image forming apparatuses illustrated in FIGS. 12A and 12B use the transfer roller 7 as the secondary transfer roller, and a transfer backup roller 36 is disposed to face and contact the transfer roller 7 (serving as the transfer rotator) via the intermediate transfer belt 38. The intermediate transfer belt 38 is entrained around a support roller 11, the transfer backup roller 36, the primary transfer rollers 39, and the like.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary. Further, except the differences described above or below, the configurations illustrated in FIGS. 12A and 12B are similar to that illustrated in FIG. 1. Thus, redundant descriptions are omitted.

Specifically, the four primary transfer rollers 39 are pressed against the corresponding photoconductor drums 5 via the intermediate transfer belt 38, and four contact portions between the primary transfer rollers 39 and the corresponding photoconductor drums 5 are hereinafter referred to as primary transfer nips. Each primary transfer roller 39 receives a primary transfer bias opposite in polarity to toner.

While rotating in the direction indicated by the arrow shown in FIG. 12A or 12B, the intermediate transfer belt 38 sequentially passes through the primary transfer nips between the photoconductor drums 5 and the corresponding primary transfer rollers 39. Then, the single-color toner images are formed on the photoconductor drums 5 through the charging, exposure, and developing processes similar to the above-described embodiments, and transferred from the respective photoconductor drums 5 primarily and superimposed one on another, into a multicolor toner image, on the intermediate transfer belt 38.

Then, the intermediate transfer belt 38 carrying the multicolor toner image reaches a position facing the transfer roller 7. At that position, the transfer backup roller 36 and the transfer roller 7 press against each other via the intermediate transfer belt 38, and the contact portion therebetween is hereinafter referred to as a secondary transfer nip. The multicolor toner image formed on the intermediate transfer belt 38 is transferred onto the sheet P (recording medium) transported to the secondary transfer nip (secondary transfer process).

In the configuration illustrated in FIG. 12A, the power supply 35 applies the transfer bias and the cleaning bias to the transfer roller 7 serving as the secondary transfer roller similar to the above described embodiments so that standard transfer process (secondary transfer process) and the transfer roller cleaning are executed.

By contrast, in the configuration illustrated in FIG. 12B, the power supply 35 applies the transfer bias and the cleaning bias to not the transfer roller 7 but the transfer backup roller 36. In this case, timings at which the transfer bias and the cleaning bias are applied to the transfer backup roller 36 are similar to those described with reference to FIGS. 4A through 7 or those for the configuration illustrated in FIG. 12A. However, the polarity of the transfer bias and the cleaning bias applied to the transfer backup roller 36 is opposite the polarity of the transfer bias and the cleaning bias described with reference to FIGS. 4A through 7 or those biases for the configuration illustrated in FIG. 12A. For example, the case of low-productivity mode is described with reference to FIG. 7.

In contrast to those shown in FIG. 7, when the target of bias application is the transfer backup roller 36, the transfer bias negative in polarity is applied to the transfer backup roller 36 for the standard transfer process. In the sheet feeding interval X3, the first cleaning bias that is positive in polarity is applied to the transfer backup roller 36, and subsequently the second cleaning bias that is negative in polarity is applied thereto, thereby cleaning the transfer roller 7.

Additionally, in another embodiment, the transfer bias, the cleaning bias, and the non-image area bias are applied to each of the transfer roller 7 and the transfer backup roller 36. In this case, application of the transfer bias, the cleaning bias, and the non-image area bias for the configuration illustrated in FIG. 12A is concurrent with application of those for the configuration illustrated in FIG. 12B. In another embodiment, at least one of the transfer bias, the cleaning bias, and the non-image area bias may be applied to the transfer roller 7, and the rest may be applied to the transfer backup roller 36.

In such configurations, effects similar to those attained by the above-described embodiments are also attained.

Additionally, although the non-image area bias is set to 0 μA in the above-described embodiments, the non-image area bias is not limited thereto. Alternatively, the non-image area bias applied to the transfer roller 7 (or the transfer backup roller 36, or both of the transfer roller 7 and the transfer backup roller 36) is set a value smaller in absolute value than the cleaning bias.

Specifically, in the non-image bias application time Z, in which the cleaning bias application is not executed in the sheet feeding interval X, the power supply 35 is controlled to keep the value of current that flows to the transfer roller 7 to a predetermined current value smaller in absolute value than the current value of the cleaning bias. For example, when the cleaning bias includes the first cleaning bias opposite in polarity to the transfer bias and the second cleaning bias identical in polarity to the transfer bias, the predetermined current value is smaller in absolute value than each of the first cleaning bias and the second cleaning bias. By contrast, when the cleaning bias includes at least one bias opposite in polarity to the transfer bias and does not include a bias identical in polarity to the transfer bias, the predetermined current value is smaller in absolute value than the at least one opposite polarity bias. The non-image area bias, however, is preferably small not to attract neither the normally charged toner nor the reversely charged toner to the transfer roller 7.

Further, although the power supply 35 (the bias application device) according to the above-described embodiments is controlled under constant current control, alternatively, the power supply 35 is controlled under constant voltage control in another embodiment. In this case, it is preferable that the power supply 35 is controlled, under constant voltage, to keep the value of the non-image area bias at 0 V similarly.

In such configurations, effects similar to those attained by the above-described embodiments are also attained.

Additionally, the above-described features can be embodied as an image forming method that includes a step of feeding multiple sheets successively to a transfer nip between a transfer rotator and a backup roller, a step of applying, to at least one of the transfer rotator and the backup roller, a transfer bias to transfer a toner image from an image bearer onto a sheet; a step of keeping a current applied to at least one of the transfer rotator and the backup roller at a value (preferably 0 μm) smaller in absolute value than a cleaning bias for a time Z out of a sheet feeding interval X (interval between sheets) during successive feeding of multiple sheets, and a step of applying the cleaning bias (smaller in absolute value than the transfer bias) to at least one of the transfer rotator and the backup roller for a time expressed as X−Z.

Numerous additional modifications and variations are possible in light of the above teachings. It is therefore to be understood that within the scope of the appended claims, the present disclosure may be practiced otherwise than as specifically described herein. Such variations are not to be regarded as a departure from the scope of the present disclosure and appended claims, and all such modifications are intended to be included within the scope of the present disclosure and appended claims. The number, position, and shape of the components of the image forming apparatus described above are not limited to those described above.

What is claimed is:

1. An image forming system comprising:
an image forming apparatus; and
a sheet processing apparatus to post-process a sheet,
wherein the image forming apparatus includes:
an image bearer to bear a toner image,
a transfer rotator to contact the image bearer to form a transfer nip therebetween,
a bias application device to apply a bias to the transfer rotator, and
a controller to control the bias application device,
wherein the controller sets a sheet feeding interval to a first interval when no post-processing is performed by the sheet processing apparatus,
wherein the controller sets the sheet feeding interval to a second interval longer than the first interval when the post-processing is performed by the sheet processing apparatus,
wherein the image bearer directly contacts the transfer rotator during both the first interval and the second interval,
wherein a cleaning bias is not applied to the transfer rotator in the first interval and is applied to the transfer rotator in the second interval by the bias application device, and
wherein an application time period of the cleaning bias is a fixed value regardless of a length of the second interval.

2. The image forming system according to claim 1, wherein the sheet processing apparatus is connectable to the image forming apparatus.

3. The image forming system according to claim 2, wherein the image forming apparatus further includes:
a sheet outlet,
wherein the sheet processing apparatus includes a sheet inlet connectable to the sheet outlet.

4. The image forming system according to claim 2, wherein the sheet processing apparatus is connectable to a lateral side of the image forming apparatus.

5. The image forming system according to claim 1, wherein the cleaning bias includes a first cleaning bias and a second cleaning bias, and
wherein the first cleaning bias has a first polarity and the second cleaning bias has a second polarity opposite of the first polarity.

6. The image forming system according to claim 1, wherein an application time period of the cleaning bias is a fixed value regardless of a length of the second interval.

7. The image forming system according to claim 1, wherein the controller controls the bias application device to keep a non-image area bias applied to the transfer rotator to be 0 μA or 0 V in the first interval.

8. The image forming system according to claim 7, wherein the controller controls the bias application device to keep the non-image area bias applied to the transfer rotator to be 0 μA or 0 V for an entire time period of the first interval.

9. An image forming system comprising:
an image forming apparatus; and
a sheet processing apparatus to post-process a sheet,
wherein the image forming apparatus includes:
an image bearer to bear a toner image,
a transfer rotator to contact the image bearer to form a transfer nip therebetween,
a bias application device to apply a bias to the transfer rotator, and
a controller to control the bias application device,
wherein the controller sets a sheet feeding interval to a first interval when no post-processing is performed by the sheet processing apparatus,
wherein the controller sets the sheet feeding interval to a second interval longer than the first interval when the post-processing is performed by the sheet processing apparatus,
wherein the image bearer directly contacts the transfer rotator during both the first interval and the second interval,
wherein a cleaning bias is not applied to the transfer rotator in the first interval and is applied to the transfer rotator in the second interval by the bias application device,
wherein the controller controls the bias application device to apply the cleaning bias for a partial time period in the second interval and to apply a non-image area bias to the transfer rotator for a remaining time period of the second interval,
wherein an absolute value of the non-image area bias is smaller than an absolute value of the cleaning bias, and
wherein a value of the non-image area bias is 0 μA under constant current control.

10. An image forming system comprising:
an image forming apparatus; and
a sheet processing apparatus to post-process a sheet,
wherein the image forming apparatus includes:
an image bearer to bear a toner image,
a transfer rotator to contact the image bearer to form a transfer nip there between,
a backup roller disposed to contact the transfer rotator via the image bearer,
a bias application device to apply a bias to the backup roller, and
a controller to control the bias application device,
wherein the controller sets a sheet feeding interval to a first interval when no post-processing is performed by the sheet processing apparatus, wherein the controller sets the sheet feeding interval to a second interval longer than the first interval when the post-processing is performed by the sheet processing apparatus, wherein the image bearer directly contacts the transfer rotator during both the first interval and the second interval, wherein a cleaning bias is not applied to the backup roller in the first interval and is applied to the backup roller in the second interval by the bias application device, and wherein an application time period of the cleaning bias is a fixed value regardless of a length of the second interval.

11. The image forming system according to claim 10, wherein the sheet processing apparatus is connectable to the image forming apparatus.

12. The image forming system according to claim 11, wherein the image forming apparatus further includes:

a sheet outlet, wherein the sheet processing apparatus includes a sheet inlet connectable to the sheet outlet.

13. The image forming system according to claim 11, wherein the sheet processing apparatus is connectable to a lateral side of the image forming apparatus.

14. The image forming system according to claim 10, wherein the cleaning bias includes a first cleaning bias and a second cleaning bias, and wherein the first cleaning bias has a first polarity and the second cleaning bias has a second polarity opposite of the first polarity.

15. An image forming system comprising:

an image forming apparatus; and a sheet processing apparatus to post-process a sheet, wherein the image forming apparatus includes:

an image bearer to bear a toner image, a transfer rotator to contact the image bearer to form a transfer nip there between, a backup roller disposed to contact the transfer rotator via the image bearer, a bias application device to apply a bias to the backup roller, and a controller to control the bias application device, wherein the controller sets a sheet feeding interval to a first interval when no post-processing is performed by the sheet processing apparatus, wherein the controller sets the sheet feeding interval to a second interval longer than the first interval when the post-processing is performed by the sheet processing apparatus, wherein the image bearer directly contacts the transfer rotator during both the first interval and the second interval, wherein a cleaning bias is not applied to the backup roller in the first interval and is applied to the backup roller in the second interval by the bias application device, wherein the controller controls the bias application device to apply the cleaning bias for a partial time period in the second interval and to apply a non-image area bias to the transfer rotator in for a remaining time period of the second interval, wherein an absolute value of the non-image area bias is smaller than an absolute value of the cleaning bias, and wherein a value of the non-image area bias is 0 μA under constant current control.

16. The image forming system according to claim 10, wherein the controller controls the bias application device to keep a non-image area bias applied to the backup roller to be 0 μA or 0 V in the first interval.

17. The image forming system according to claim 16, wherein the controller controls the bias application device to keep the non-image area bias applied to the backup roller to be 0 μA or 0 V for an entire time period of the first interval.

* * * * *